US010180122B2

(12) United States Patent
Asayama

(10) Patent No.: US 10,180,122 B2
(45) **Date of Patent: *Jan. 15, 2019**

(54) FUEL PUMP

(71) Applicant: Toyota Jidosha Kabushiki Kaisha, Toyota-shi, Aichi-ken (JP)

(72) Inventor: Kazuhiro Asayama, Nagoya (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 217 days.

This patent is subject to a terminal disclaimer.

(21) Appl. No.: 15/260,978

(22) Filed: Sep. 9, 2016

(65) Prior Publication Data

US 2017/0074255 A1 Mar. 16, 2017

(30) Foreign Application Priority Data

Sep. 11, 2015 (JP) ..... 2015-179692

(51) Int. Cl.
*F02M 37/04* (2006.01)
*F04B 23/06* (2006.01)
(Continued)

(52) U.S. Cl.
CPC ..... *F02M 37/04* (2013.01); *F02M 59/025* (2013.01); *F04B 19/22* (2013.01);
(Continued)

(58) Field of Classification Search
CPC ..... F04B 9/06; F04B 53/001; F04B 11/0075; F04B 1/02; F04B 11/0033; F04B 25/005;
(Continued)

(56) References Cited

U.S. PATENT DOCUMENTS 3,286,911 A * 11/1966 Clarke ..... F04B 25/005 417/254
3,910,729 A 10/1975 Jepsen et al.
(Continued)

FOREIGN PATENT DOCUMENTS

JP S50030306 U 4/1975
JP S50037011 A 4/1975
(Continued)

OTHER PUBLICATIONS

Notice of Allowance dated Jun. 29, 2018 Issued to U.S. Appl. No. 15/272,946, filed Sep. 22, 2016.

*Primary Examiner* — Devon Kramer
*Assistant Examiner* — David Brandt
(74) *Attorney, Agent, or Firm* — Dinsmore & Shohl LLP

(57) ABSTRACT

A fuel pump includes a plunger that reciprocates inside a cylinder. The fuel pump includes a first movable element connected to the plunger, a second movable element that functions as a counterweight for preventing or reducing vibrations that are created by reciprocation of the first movable element, an electromagnet provided between the first movable element and the second movable element, a magnetic member that is provided between the first movable element and the second movable element and that attracts both the first movable element and the second movable element when the electromagnet is energized, and a first spring that urges the first movable element and the second movable element so as to move away from each other.

5 Claims, 7 Drawing Sheets

(51) Int. Cl.
*F04B 19/22* (2006.01)
*F04B 53/14* (2006.01)
*F04B 53/16* (2006.01)
*F02M 59/02* (2006.01)

(52) U.S. Cl.
CPC ..... *F04B 23/06* (2013.01); *F04B 53/14* (2013.01); *F04B 53/16* (2013.01)

(58) Field of Classification Search
CPC ..... F04B 27/005; F04B 49/12; F04B 19/20; F04B 19/22; F04B 23/04; F04B 23/06; F04B 17/03; F04B 17/04; F04B 17/042; F04B 17/044; F04B 35/04; F04B 35/045; F04B 43/02; F04B 45/04; F04B 45/047; F04B 11/00; F04B 53/14; F04B 11/0083; F04B 53/16; F02M 37/08; F02M 37/043; F02M 37/04; F02M 59/025
See application file for complete search history.

(56) References Cited

U.S. PATENT DOCUMENTS 4,154,559 A * 5/1979 Enomoto ..... F04B 45/043 417/413.1
4,365,942 A 12/1982 Schmidt
5,469,828 A 11/1995 Heimberg et al.
5,520,154 A 5/1996 Heimberg et al.
5,907,201 A * 5/1999 Hiterer ..... F02G 1/0435 310/15
5,944,302 A * 8/1999 Loc ..... F04B 35/045 267/180
2008/0245097 A1* 10/2008 Cho ..... F04B 25/00 62/510
2008/0271708 A1 11/2008 Rodriguez-Amaya
2014/0161650 A1* 6/2014 Paweletz ..... F04B 17/03 417/415
2015/0098849 A1* 4/2015 Bagagli ..... F04B 5/02 417/488
2017/0096987 A1* 4/2017 Asayama ..... F02M 37/043

FOREIGN PATENT DOCUMENTS

JP S54036605 A 3/1979
JP H09088817 A 3/1997
JP H19170552 A 6/1997
JP 2000008996 A 1/2000
JP 2002-089413 A 3/2002
JP 2008545917 A 12/2008
JP 2014117149 A 6/2014

* cited by examiner

FUEL PUMP

CROSS-REFERENCE TO RELATED APPLICATIONS

The present disclosure claims priority to Japanese Patent Application No. 2015-179692 filed on Sep. 11, 2015, which is incorporated herein by reference in its entirety including the specification, drawings and abstract.

BACKGROUND

1. Technical Field

The present disclosure relates to a fuel pump.

2. Description of Related Art

There is known a fuel pump that pressurizes fuel in a pressurizing chamber defined by a cylinder and a plunger by the movement of the plunger inside the cylinder. An actuating mechanism for reciprocating such a plunger is, for example, the device described in Japanese Patent Application Publication No. 2014-117149 (JP 2014-117149 A). The device includes a movable element that reciprocates by an electromagnet. In the device, a piston that functions as a plunger is connected to the movable element.

Incidentally, as the movable element is reciprocated, vibrations are created by the reciprocation. In order to reduce such vibrations, a counterweight having a mass equivalent to that of the movable element is provided, and the counterweight is configured to move in a direction opposite to the moving direction of the plunger. Thus, vibrations that are created by the reciprocation of the movable element are cancelled out by vibrations that are created by the reciprocation of the counterweight.

However, in order to synchronize the motion of the counterweight with the reciprocation of the plunger, an actuating mechanism that reciprocates the counterweight, a controller for controlling the reciprocation of the counterweight, and the like, are additionally required, with the result that the configuration of the fuel pump becomes complex.

SUMMARY

The present disclosure provides a fuel pump that moves a movable element connected to a plunger and a counterweight for the movable element in synchronization with each other with a simpler configuration.

A fuel pump includes a first pump unit, a first movable element, a second movable element, an electromagnet, a magnetic member and a first spring. The first pump unit includes a first cylinder, a first plunger that reciprocates inside the first cylinder, and a first pressurizing chamber defined by the first cylinder and the first plunger. The first pump unit is configured to pressurize fuel inside the first pressurizing chamber by moving the first plunger inside the cylinder. The first movable element is connected to the first plunger. The second movable element is provided so as to face the first movable element in a direction in which the first plunger moves. The second movable element is configured to function as a counterweight for preventing or reducing vibrations that are created by reciprocation of the first movable element. The electromagnet is provided between the first movable element and the second movable element. The magnetic member is provided between the first movable element and the second movable element. The magnetic member is configured to attract both the first movable element and the second movable element when the electromagnet is energized. The first spring is configured to urge the first movable element and the second movable element so as to move away from each other.

With this configuration, when the electromagnet is energized, the first movable element and the second movable element are attracted by the electromagnet and the magnetic member, so the first movable element and the second movable element move so as to approach each other. When the electromagnet is de-energized, the first movable element and the second movable element move away from each other under the urging force of the first spring.

Therefore, by repeating energization and de-energization of the electromagnet, the first plunger connected to the first movable element reciprocates, and the second movable element that functions as the counterweight for the first movable element synchronously moves in a direction opposite to the direction in which the first movable element moves. For this reason, vibrations that are created by the reciprocation of the first movable element are cancelled out by vibrations that are created by the reciprocation of the second movable element.

With the above configuration, the first movable element connected to the first plunger and the second movable element that functions as the counterweight reciprocate in synchronization with each other by the use of the electromagnet, the magnetic member and the first spring. For this reason, without additionally providing a drive mechanism that reciprocates a counterweight, a controller for controlling the reciprocation of the counterweight, or the like, a movable element connected to a plunger and a counterweight for the movable element are moved in synchronization with each other with a simpler configuration.

The fuel pump may further include a housing, a second spring and a third spring. The housing accommodates the first movable element and the second movable element. The second spring is arranged between the first movable element and the housing. The second spring is configured to urge the first movable element in a direction in which the first movable element approaches the magnetic member. The third spring is arranged between the second movable element and the housing. The third spring is configured to urge the second movable element in a direction in which the second movable element approaches the magnetic member.

A distance between the first movable element and the magnetic member and a distance between the second movable element and the magnetic member change in response to an energization state of the electromagnet. When a change in the distance between each movable element and the magnetic member is regarded as an actuated amount of the movable element, if there occurs a difference between the actuated amounts of the movable elements in process in which the movable elements are attracted by the magnetic member or in process in which the movable elements move away from the magnetic member, the period of the reciprocation of the first movable element and the period of the reciprocation of the second movable element deviate from each other. As a result, the effect of preventing or reducing vibrations of the first movable element by using the reciprocation of the second movable element decreases.

In this respect, with the above configuration, when there is a difference between a deflection amount of the second spring and a deflection amount of the third spring due to a difference in actuated amount between the movable elements, there occurs a difference between the urging force of the second spring, which acts on the first movable element, and the urging force of the third spring, which acts on the second movable element. The first movable element and the second movable element are urged by one of the springs, having a larger urging force, due to such a difference in urging force, so the distance between the first movable element and the magnetic member and the distance between the second movable element and the magnetic member both change, and a difference between the actuated amounts of the movable elements reduces.

For example, when the distance between the first movable element and the magnetic member is longer than the distance between the second movable element and the magnetic member and the deflection amount of the second spring is larger than the deflection amount of the third spring, the urging force of the second spring, which acts on the first movable element, is larger than the urging force of the third spring, which acts on the second movable element. Therefore, the first movable element is urged by the urging force of the second spring in a direction in which the first movable element approaches the magnetic member, while the second movable element is urged in a direction in which the second movable element moves away from the magnetic member. In this way, when the distance between the first movable element and the magnetic member is longer than the distance between the second movable element and the magnetic member, the first movable element is pressed in a direction in which the first movable element approaches the magnetic member, and the second movable element is pressed in a direction in which the second movable element moves away from the magnetic member, so a difference in actuated amount between the first movable element and the second movable element reduces.

In this way, with the above configuration, it is possible to reduce a difference in actuated amount between the movable elements, so it is possible to prevent a deviation between the period of the reciprocation of the first movable element and the period of the reciprocation of the second movable element.

The fuel pump may further include a second pump unit. The second pump unit includes a second cylinder, a second plunger and a second pressuring chamber. The second plunger reciprocates inside the second cylinder. The second pressurizing chamber is defined by the second cylinder and the second plunger. The second pump unit is configured to pressurize fuel inside the second pressurizing chamber by moving the second plunger inside the second cylinder. The second plunger may be connected to the second movable element.

With the above configuration, the second plunger is also reciprocated by the reciprocation of the second movable element, so it is possible to drive two pump units with the use of one fuel pump without additionally providing a drive mechanism for reciprocating the second plunger.

The fuel pump may be provided inside a fuel tank. A feed pump that draws fuel inside the fuel tank and a controller that controls the driving of the feed pump may be omitted.

BRIEF DESCRIPTION OF THE DRAWINGS

Features, advantages, and technical and industrial significance of exemplary embodiments of the present disclosure will be described below with reference to the accompanying drawings, in which like numerals denote like elements, and wherein.

DETAILED DESCRIPTION OF EMBODIMENTS

Hereinafter, a fuel pump according to an embodiment will be described in detail with reference to FIG. 1 to FIG. 6. The fuel pump 50 according to the present embodiment is configured as a high-pressure fuel pump that is provided in a vehicle-mounted direct injection engine.

Figure 1:
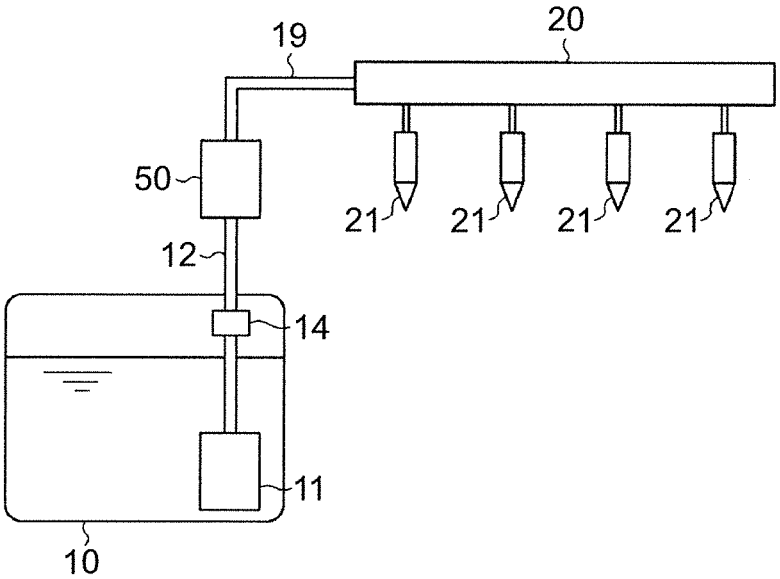
FIG. 1 is a schematic view that schematically shows the configuration of a fuel system of an engine, in which a fuel pump according to an embodiment is installed.

As shown in FIG. 1, a feed pump 11 that draws fuel is provided inside the fuel tank 10 of the direct injection engine. The feed pump 11 is connected to the fuel pump 50 via a low-pressure fuel passage 12. A regulator 14 is provided in the low-pressure fuel passage 12. The regulator 14 drains fuel inside the low-pressure fuel passage 12 to the fuel tank 10 when a fuel pressure inside the low-pressure fuel passage 12 exceeds a prescribed value.

The fuel pump 50 is, for example, provided near the fuel tank, and is connected to a delivery pipe 20 via a high-pressure fuel passage 19. Injectors 21 are connected to the delivery pipe 20. The injectors 21 are respectively provided in correspondence with cylinders of the direct injection engine.

Figure 2:
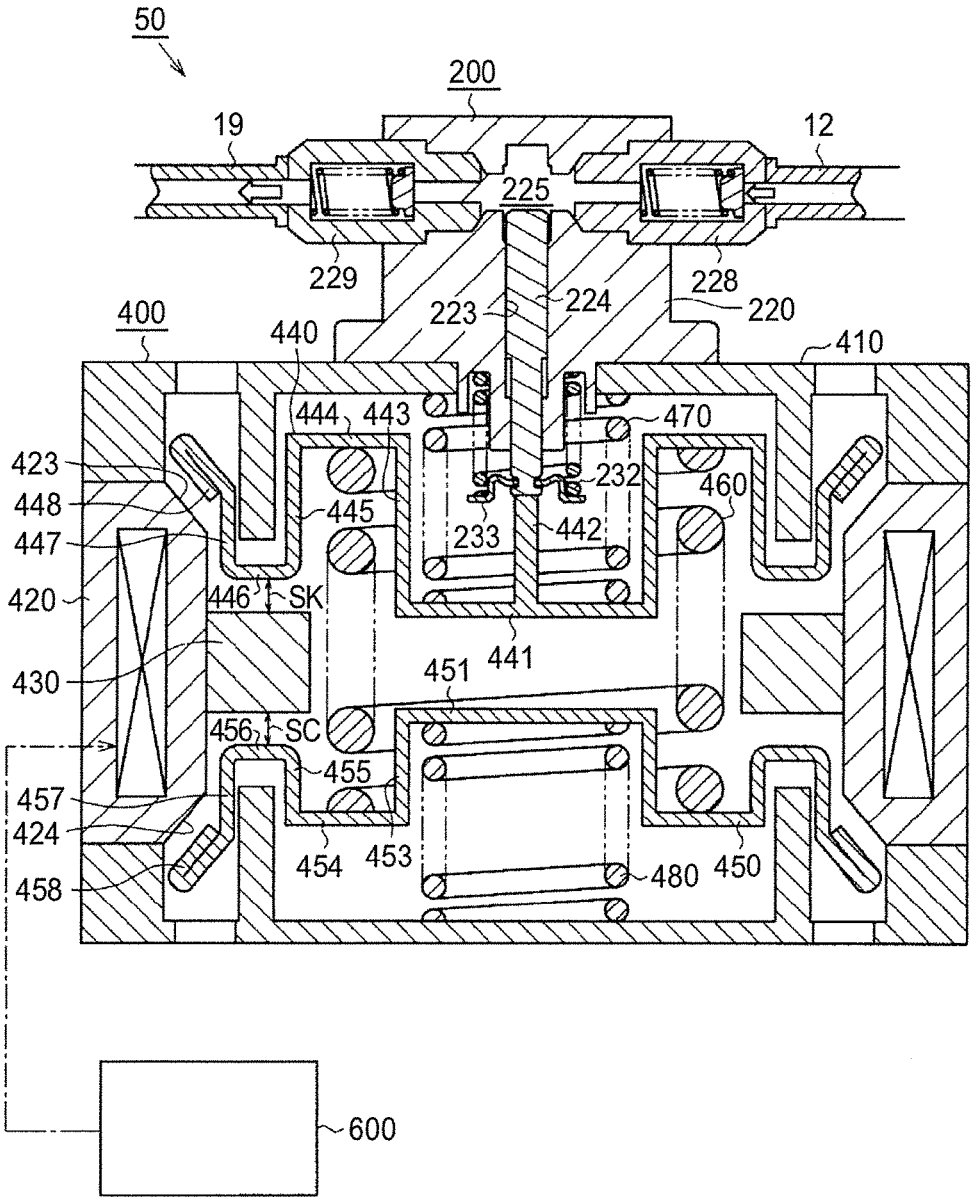
FIG. 2 is a cross-sectional view of the fuel pump according to the embodiment.

As shown in FIG. 2, the fuel pump 50 includes a pump unit 200 and a drive unit 400. The pump unit 200 discharges high-pressure fuel. The drive unit 400 drives the pump unit 200. The pump unit 200 includes a pump body 220 in which a cylindrical cylinder 223 is formed. A round-bar plunger 224 is arranged in the cylinder 223 so as to be reciprocable. The plunger 224 is arranged in a state where one end is inserted in the cylinder 223 and the other end protrudes outward from the cylinder 223. The inside of the cylinder 223 is defined by the plunger 224 to form a pressurizing chamber 225 for pressurizing fuel.

The pump body 220 includes a first check valve 228. The first check valve 228 permits low-pressure fuel, which is fed via the low-pressure fuel passage 12, to flow into the pressurizing chamber 225, and blocks flow of fuel from the pressurizing chamber 225 into the low-pressure fuel passage 12.

The pump body 220 includes a second check valve 229. The second check valve 229 permits high-pressure fuel, which has been pressurized in the pressurizing chamber 225, to flow into the high-pressure fuel passage 19, and blocks flow of fuel from the high-pressure fuel passage 19 into the pressurizing chamber 225.

An annular spring seat 233 is assembled to the end of the plunger 224, which protrudes outward from the cylinder 223. A spring 232 is arranged between the spring seat 233 and the pump body 220. The spring 232 urges the plunger 224 in a direction in which the plunger 224 recedes from the pressurizing chamber 225.

The drive unit 400 includes a cylindrical housing 410. The pump unit 200 is assembled to the outer periphery of the housing 410 such that the end of the plunger 224, at which the spring seat 233 is provided, is exposed to the inside of the housing 410.

A first movable element 440 is provided inside the housing 410. The first movable element 440 has a substantially disc shape, and is made of a soft magnetic material. A circular plate-shaped first planar portion 441 is provided at the center of the first movable element 440. The first planar portion 441 expands parallel to the radial direction of the first movable element 440. A bar-shaped connecting portion 442 extends from the center of the first planar portion 441. The connecting portion 442 is connected to the end of the plunger 224.

A cylindrical first wall portion 443 is provided at the outer periphery of the first planar portion 441. The first wall portion 443 extends toward a side at which the pump unit 200 is arranged. An annular second planar portion 444 is provided at the distal end of the first wall portion 443. The second planar portion 444 expands parallel to the radial direction of the first movable element 440.

A cylindrical second wall portion 445 is provided at the outer periphery of the second planar portion 444. The second wall portion 445 extends toward a side opposite to the side at which the pump unit 200 is arranged. An annular third planar portion 446 is provided at the distal end of the second wall portion 445. The third planar portion 446 expands parallel to the radial direction of the first movable element 440.

A cylindrical third wall portion 447 is provided at the outer periphery of the third planar portion 446. The third wall portion 447 extends toward the side at which the pump unit 200 is arranged. An annular first taper portion 448 is provided at the distal end of the third wall portion 447. The first taper portion 448 is inclined to expand in the radial direction of the first movable element 440.

A second movable element 450 is provided inside the housing 410. The second movable element 450 is provided so as to face the first movable element 440 in the direction in which the plunger 224 moves.

The second movable element 450 also has a substantially disc shape, and is made of a soft magnetic material. A disc-shaped fourth planar portion 451 is provided at the center of the second movable element 450. The fourth planar portion 451 expands parallel to the radial direction of the second movable element 450.

A cylindrical fourth wall portion 453 is provided at the outer periphery of the fourth planar portion 451. The fourth wall portion 453 extends toward the side opposite to the side at which the pump unit 200 is arranged. An annular fifth planar portion 454 is provided at the distal end of the fourth wall portion 453. The fifth planar portion 454 expands parallel to the radial direction of the second movable element 450.

A cylindrical fifth wall portion 455 is provided at the outer periphery of the fifth planar portion 454. The fifth wall portion 455 extends toward the side at which the pump unit 200 is arranged. An annular sixth planar portion 456 is provided at the distal end of the fifth wall portion 455. The sixth planar portion 456 extends parallel to the radial direction of the second movable element 450.

A cylindrical sixth wall portion 457 is provided at the outer periphery of the sixth planar portion 456. The sixth wall portion 457 extends toward the side opposite to the side at which the pump unit 200 is arranged. An annular second taper portion 458 is provided at the distal end of the sixth wall portion 457. The second taper portion 458 is inclined to expand in the radial direction of the second movable element 450.

The second movable element 450 is provided so as to function as a counterweight for preventing or reducing vibrations that are created by the reciprocation of the first movable element 440. The thickness, size, and the like, of each of the first movable element 440 and second movable element 450 are set such that the mass of the first movable element 440 is substantially equal to the mass of the second movable element 450. For information, in order for the mass of the first movable element 440 and the mass of the second movable element 450 to be equal to each other as much as possible, the first movable element 440 or the second movable element 450 may have a hole or flange for adjusting the mass. When the mass of the plunger 224 is unignorably larger than the mass of the first movable element 440, it is desirable that the mass of the second movable element 450 be substantially equal to the sum of the mass of the first movable element 440 and the mass of the plunger 224.

An annular electromagnet 420 is arranged inside the housing 410 along the circumferential direction of the housing 410. The electromagnet 420 is provided between the first movable element 440 and the second movable element 450. More specifically, the electromagnet 420 has a first inclined portion 423 and a second inclined portion 424. The first inclined portion 423 faces the first taper portion 448. The second inclined portion 424 faces the second taper portion 458. The electromagnet 420 is placed between the first taper portion 448 of the first movable element 440 and the second taper portion 458 of the second movable element 450.

A ring-shaped magnetic member 430 is arranged on the inner peripheral side of the electromagnet 420. The magnetic member 430 is made of a soft magnetic material, such as iron. The magnetic member 430 is arranged between the third planar portion 446 of the first movable element 440 and the sixth planar portion 456 of the second movable element 450.

A first spring 460 is arranged between the second planar portion 444 of the first movable element 440 and the fifth planar portion 454 of the second movable element 450. The first spring 460 urges the first movable element 440 and the second movable element 450 such that the first movable element 440 and the second movable element 450 move away from each other.

A second spring 470 is arranged between the first planar portion 441 of the first movable element 440 and the inner wall of the housing 410, facing the first planar portion 441. The second spring 470 urges the first movable element 440 in a direction in which the first movable element 440 approaches the magnetic member 430.

A third spring 480 is arranged between the fourth planar portion 451 of the second movable element 450 and the inner wall of the housing 410, facing the fourth planar portion 451. The third spring 480 urges the second movable element 450 in a direction in which the second movable element 450 approaches the magnetic member 430.

The second spring 470 and the third spring 480 have the same free length, spring constant and preload when assembled in the drive unit 400. The spring constant of each of the second spring 470 and the third spring 480 is sufficiently smaller than the spring constant of the first spring 460. Thus, the urging force of the second spring 470 and third spring 480 does not impair the first spring 460 from urging the first movable element 440 and the second movable element 450 so as to move away from each other.

In a state where the first movable element 440 and the second movable element 450 are maximally spaced apart from each other under the urging force of the first spring 460, the shape, arrangement, and the like, of each of the first movable element 440 and the second movable element 450 are set such that a distance SK between the third planar portion 446 of the first movable element 440 and the magnetic member 430 is equal to a distance SC between the sixth planar portion 456 of the second movable element 450 and the magnetic member 430.

Figure 3:
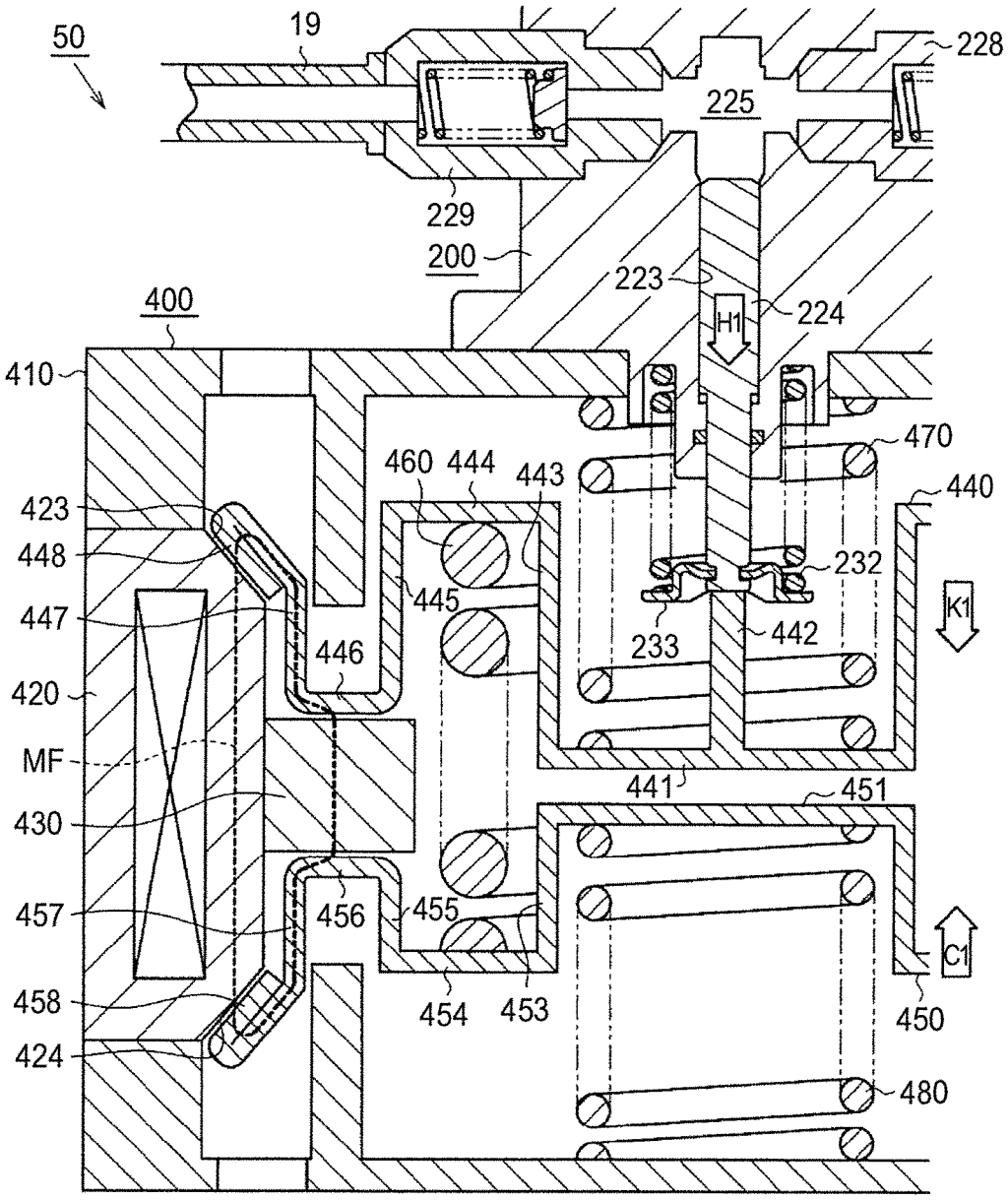
FIG. 3 is a cross-sectional view that shows the fuel pump according to the embodiment in a state where an electromagnet is energized.

A controller 600 for executing energization control is connected to the electromagnet 420. As shown in FIG. 3, as the electromagnet 420 is energized, because the first movable element 440, the second movable element 450 and the magnetic member 430 are made of a soft magnetic material, a magnetic flux MF (indicated by the dashed line in FIG. 3) generated by the electromagnet 420 flows annularly through the first inclined portion 423 of the electromagnet 420, the first taper portion 448, third wall portion 447 and third planar portion 446 of the first movable element 440, the magnetic member 430, the sixth planar portion 456, sixth wall portion 457 and second taper portion 458 of the second movable element 450 and the second inclined portion 424 of the electromagnet 420. That is, one magnetic circuit is formed of the first movable element 440, the second movable element 450, the magnetic member 430 and the electromagnet 420. As a result, the first movable element 440 and the second movable element 450 are attracted by the electromagnet 420 and the magnetic member 430, the first movable element 440 moves in a direction in which the first movable element 440 approaches the magnetic member 430 (the arrow K1 direction shown in FIG. 3), and the second movable element 450 also moves in a direction in which the second movable element 450 approaches the magnetic member 430 (the arrow C1 direction shown in FIG. 3). Therefore, as the electromagnet 420 is energized, the first movable element 440 and the second movable element 450 move so as to approach each other.

As the first movable element 440 is attracted by the electromagnet 420 and the magnetic member 430 and moves in the arrow K1 direction, the plunger 224 connected to the connecting portion 442 moves in a direction in which the volume of the pressurizing chamber 225 increases (the arrow H1 direction shown in FIG. 3). In the following description, movement of the plunger 224 in the direction in which the volume of the pressurizing chamber 225 increases is termed downward movement of the plunger 224. As the plunger 224 moves downward in this way, the pressure in the pressurizing chamber 225 decreases, and fuel is introduced from the low-pressure fuel passage 12 into the pressurizing chamber 225 via the first check valve 228.

Figure 4:
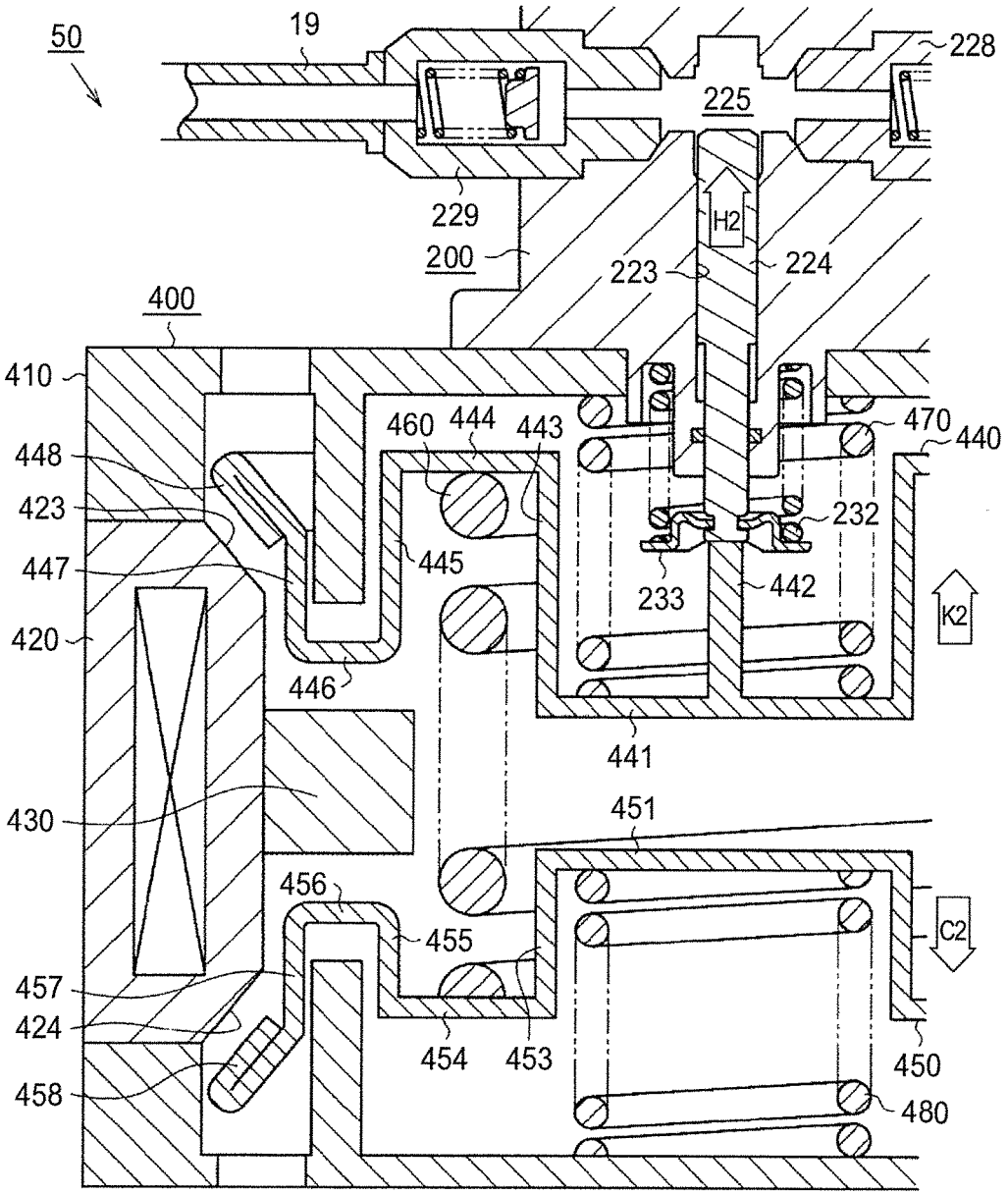
FIG. 4 is a cross-sectional view that shows the fuel pump according to the embodiment in a state where the electromagnet is de-energized.

As shown in FIG. 4, as the electromagnet 420 is de-energized, the first movable element 440 and the second movable element 450 move so as to move away from each other under the urging force of the first spring 460. That is, the first movable element 440 moves in a direction in which the first movable element 440 moves away from the magnetic member 430 (the arrow K2 direction shown in FIG. 4), and the second movable element 450 also moves in a direction in which the second movable element 450 moves away from the magnetic member 430 (the arrow C2 direction shown in FIG. 4).

As the first movable element 440 moves in the arrow K2 direction, the plunger 224 connected to the connecting portion 442 moves in a direction in which the volume of the pressurizing chamber 225 reduces (the arrow H2 direction shown in FIG. 4). In the following description, movement of the plunger 224 in the direction in which the volume of the pressurizing chamber 225 reduces is termed upward movement of the plunger. As the plunger 224 moves upward in this way, fuel inside the pressurizing chamber 225 is pressurized and is discharged to the high-pressure fuel passage 19 via the second check valve 229.

For information, the first movable element 440 and the second movable element 450 stop moving away from each other at the time when the urging force of the first spring 460, which reduces as the first spring 460 extends, balances with the urging force of the second spring 470 and third spring 480, which increases as the second spring 470 and the third spring 480 are compressed. The position of the plunger 224 at the time when the first movable element 440 and the second movable element 450 stop moving away from each other, that is, at the time when the first movable element 440 and the second movable element 450 are maximally spaced apart from each other under the urging force of the first spring 460, is the top dead center of the plunger 224 inside the cylinder 223.

The displacement of the fuel pump 50 is variably set by changing the stroke amount ST of the plunger 224. That is, the distance SK between the first movable element 440 and the magnetic member 430 and the distance SC between the second movable element 450 and the magnetic member 430 change in response to the energization state of the electromagnet 420. That is, as the electromagnet 420 is energized, the distance SK and the distance SC become shorter; whereas, as the electromagnet 420 is de-energized, the distance SK and the distance SC become longer. Such a change in distance between each movable element and the magnetic member 430 is termed an actuated amount of the movable element in the following description. Where the actuated amount of a state where the first movable element 440 and the second movable element 450 are maximally spaced apart from each other under the urging force of the first spring 460 is "0", the actuated amount of the first movable element 440 at the time when the position of the plunger 224 is the top dead center is "0". In this case, as the actuated amount of the first movable element 440 increases, that is, as the first movable element 440 approaches the magnetic member 430, the stroke amount ST (downward movement amount) of the plunger 224 from the top dead center also increases, and a larger amount of fuel is introduced into the pressurizing chamber 225, so the displacement of the fuel pump 50 increases.

Figure 5:
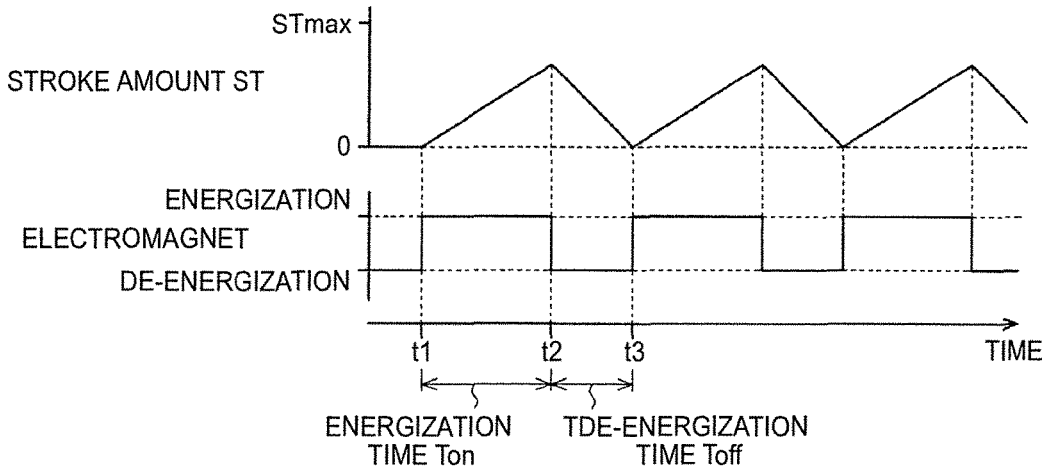
FIG. 5 is a timing chart that shows the relationship between an energization state of the electromagnet provided in the fuel pump according to the embodiment and a stroke amount of a plunger.

As shown in FIG. 5, as the electromagnet 420 is energized, the first movable element 440 approaches the magnetic member 430, so the stroke amount ST increases as an energization time Ton of the electromagnet 420 extends. At the time when the first movable element 440 approaches to contact the magnetic member 430, the stroke amount ST becomes a maximum value STmax.

As the electromagnet 420 is de-energized, the first movable element 440 that has approached the magnetic member 430 moves away from the magnetic member 430. After a lapse of a predetermined time from when the electromagnet 420 is de-energized, the actuated amount of the first movable element 440 becomes "0", and the stroke amount ST also becomes "0". A de-energization time Toff of the electromagnet 420, required from when the electromagnet 420 is de-energized to when the stroke amount ST becomes "0", extends as the stroke amount ST of the plunger 224 increases, so the de-energization time Toff may be set on the basis of the energization time Ton of the electromagnet 420.

The controller 600 sets the energization time Ton on the basis of a required displacement of the fuel pump 50 such that the energization time Ton becomes longer as the required displacement increases. The controller 600 sets the de-energization time Toff such that the de-energization time Toff becomes longer as the set energization time Ton becomes longer. The controller 600 adjusts the displacement of the fuel pump 50 to a desired required displacement by alternately repeating energization of the electromagnet 420 over the energization time Ton and de-energization of the electromagnet 420 over the de-energization time Toff.

The above-described energization control for adjusting the stroke amount ST is one example, and the stroke amount ST may be changed in another mode. Next, the operation of the fuel pump 50 will be described.

As described above, as the electromagnet 420 is energized, the first movable element 440 and the second movable element 450 are attracted by the electromagnet 420 and the magnetic member 430, so the first movable element 440 and the second movable element 450 move so as to approach each other. As the electromagnet 420 is de-energized, the first movable element 440 and the second movable element 450 move so as to move away from each other under the urging force of the first spring 460.

Therefore, by repeating energization and de-energization of the electromagnet 420, the plunger 224 connected to the first movable element 440 reciprocates, and the second movable element 450 that functions as the counterweight for the first movable element 440 synchronously moves in the direction opposite to the direction in which the first movable element 440 moves. For this reason, vibrations that are created by the reciprocation of the first movable element 440 are cancelled by vibrations that are created by the reciprocation of the second movable element 450.

In this way, the first movable element 440 connected to the plunger 224 and the second movable element 450 that functions as the counterweight reciprocate in synchronization with each other by the use of the electromagnet 420, the magnetic member 430 and the first spring 460.

If there is a difference between the actuated amounts of the movable elements in process in which the first movable element 440 and the second movable element 450 are attracted by the magnetic member 430 or in process in which the first movable element 440 and the second movable element 450 move away from the magnetic member 430, the period of the reciprocation of the first movable element 440 and the period of the reciprocation of the second movable element 450 deviate from each other, so the effect of preventing or reducing vibrations of the first movable element 440 by using the reciprocation of the second movable element 450 decreases.

In this respect, with the fuel pump 50, when there is a difference between a deflection amount of the second spring 470 and a deflection amount of the third spring 480 due to a difference in actuated amount between the first movable element 440 and the second movable element 450, there occurs a difference between the urging force of the second spring 470, which acts on the first movable element 440, and the urging force of the third spring 480, which acts on the second movable element 450. The first movable element 440 and the second movable element 450 are urged by one of the springs, having a larger urging force, due to such a difference in urging force, so the distance SK between the first movable element 440 and the magnetic member 430 and the distance SC between the second movable element 450 and the magnetic member 430 both change, and a difference between the actuated amounts of the movable elements reduces.

Figure 6:
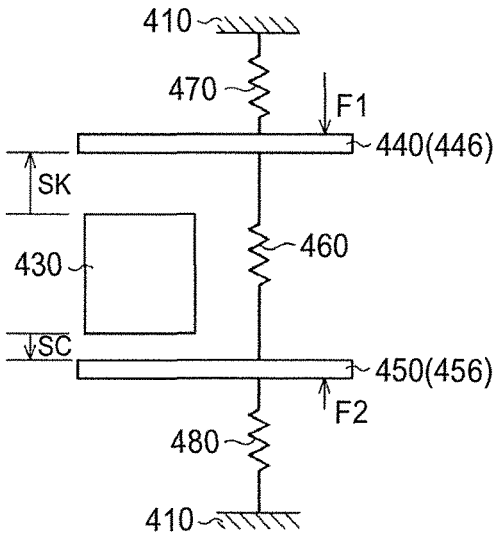
FIG. 6 is a schematic view that shows the arrangement of springs provided in the fuel pump according to the embodiment.

As shown in FIG. 6, for example, in process in which the first movable element 440 and the second movable element 450 are attracted by the magnetic member 430 or in process in which the first movable element 440 and the second movable element 450 move away from the magnetic member 430, when the distance SK between the first movable element 440 and the magnetic member 430 becomes longer than the distance SC between the second movable element 450 and the magnetic member 430 and there is a difference in actuated amount between the first movable element 440 and the second movable element 450, the deflection amount (compression amount) of the second spring 470 becomes larger than the deflection amount (compression amount) of the third spring 480. In this case, the urging force Fl of the second spring 470, which acts on the first movable element 440, becomes larger than the urging force F2 of the third spring 480, which acts on the second movable element 450. Therefore, the first movable element 440 is urged by the urging force F1 of the second spring 470 in a direction in which the first movable element 440 approaches the magnetic member 430, while the second movable element 450 is urged in a direction in which the second movable element 450 moves away from the magnetic member 430. In this way, when the distance SK between the first movable element 440 and the magnetic member 430 is longer than the distance SC between the second movable element 450 and the magnetic member 430, the first movable element 440 is urged in a direction in which the first movable element 440 approaches the magnetic member 430, and the second movable element 450 is urged in a direction in which the second movable element 450 moves away from the magnetic member 430. For this reason, a difference between the distance SK between the first movable element 440 and the magnetic member 430 and the distance SC between the second movable element 450 and the magnetic member 430 reduces, and a difference in actuated amount between the first movable element 440 and the second movable element 450 reduces.

As the electromagnet 420 is de-energized, the first movable element 440 and the second movable element 450 move away from each other under the urging force of the first spring 460. If the first movable element 440 and the second movable element 450 are stopped to move away from each other by, for example, bringing the movable elements into contact with stoppers provided inside the housing 410, there is a possibility that collision noise occurs at the stoppers.

In this respect, in the present embodiment, as described above, the first movable element 440 and the second movable element 450 stop moving away from each other at the time when the urging force of the first spring 460, which reduces as the first spring 460 extends, balances with the urging force of the second spring 470 and third spring 480, which increases as the second spring 470 and the third spring 480 are compressed. Therefore, it is not required to necessarily provide the above-described stoppers, so occurrence of collision noise as described above is also prevented.

On the one hand, when the plunger of the fuel pump that pressurizes fuel for the direct injection engine is reciprocated by the use of a camshaft provided on a cylinder head, the fuel pump is mostly provided on the cylinder head of which the temperature rises during engine operation. In this case, in order to prevent or reduce occurrence of vapor due to engine heat in low-pressure fuel that is supplied toward the fuel pump, it is required to somewhat raise the feed pressure of the feed pump that feeds fuel from the fuel tank toward the fuel pump.

On the other hand, the fuel pump according to the present embodiment is an electric fuel pump that uses the electromagnet 420, so the fuel pump is not required to be provided on the cylinder head that rises in temperature, and the fuel pump may be provided at a portion of which an ambient temperature is relatively low, such as near the fuel tank 10. Therefore, vapor due to engine heat is hard to occur in low-pressure fuel that is supplied toward the fuel pump 50, so it is possible to decrease the feed pressure of the feed pump 11 in comparison with the case where the fuel pump is provided on the cylinder head.

As described above, according to the present embodiment, the following advantageous effects are obtained.

(1) The first movable element 440 connected to the plunger 224 and the second movable element 450 that functions as the counterweight reciprocate in synchronization with each other by the use of the electromagnet 420, the magnetic member 430 and the first spring 460. For this reason, without additionally providing a drive mechanism that reciprocates the second movable element 450 that functions as the counterweight, a controller for controlling the reciprocation of the second movable element 450, or the like, the first movable element 440 connected to the plunger 224 and the second movable element 450 that functions as the counterweight for the first movable element 440 are moved in synchronization with each other with a simpler configuration.

(2) By providing the second spring 470 and the third spring 480, it is possible to reduce a difference in actuated amount between the first movable element 440 and the second movable element 450, so it is possible to prevent a deviation between the period of the reciprocation of the first movable element 440 and the period of the reciprocation of the second movable element 450.

(3) By providing the second spring 470 and the third spring 480, it is possible to stop movement of the first movable element 440 and the second movable element 450 away from each other even when no stopper is provided inside the housing 410. Therefore, it is possible to prevent occurrence of collision noise that can occur when stoppers are provided.

(4) The fuel pump 50 is allowed to be provided at a portion of which the ambient temperature is relatively low, so it is possible to decrease the feed pressure of the feed pump 11. For this reason, it is possible to reduce the driving energy of the feed pump 11.

The above-described embodiment may be modified into the following alternative embodiment.

The fuel pump 50 includes the pump unit 200 that discharges high-pressure fuel. Other than the above, another pump unit different from the pump unit 200 may be further provided.

Figure 7:
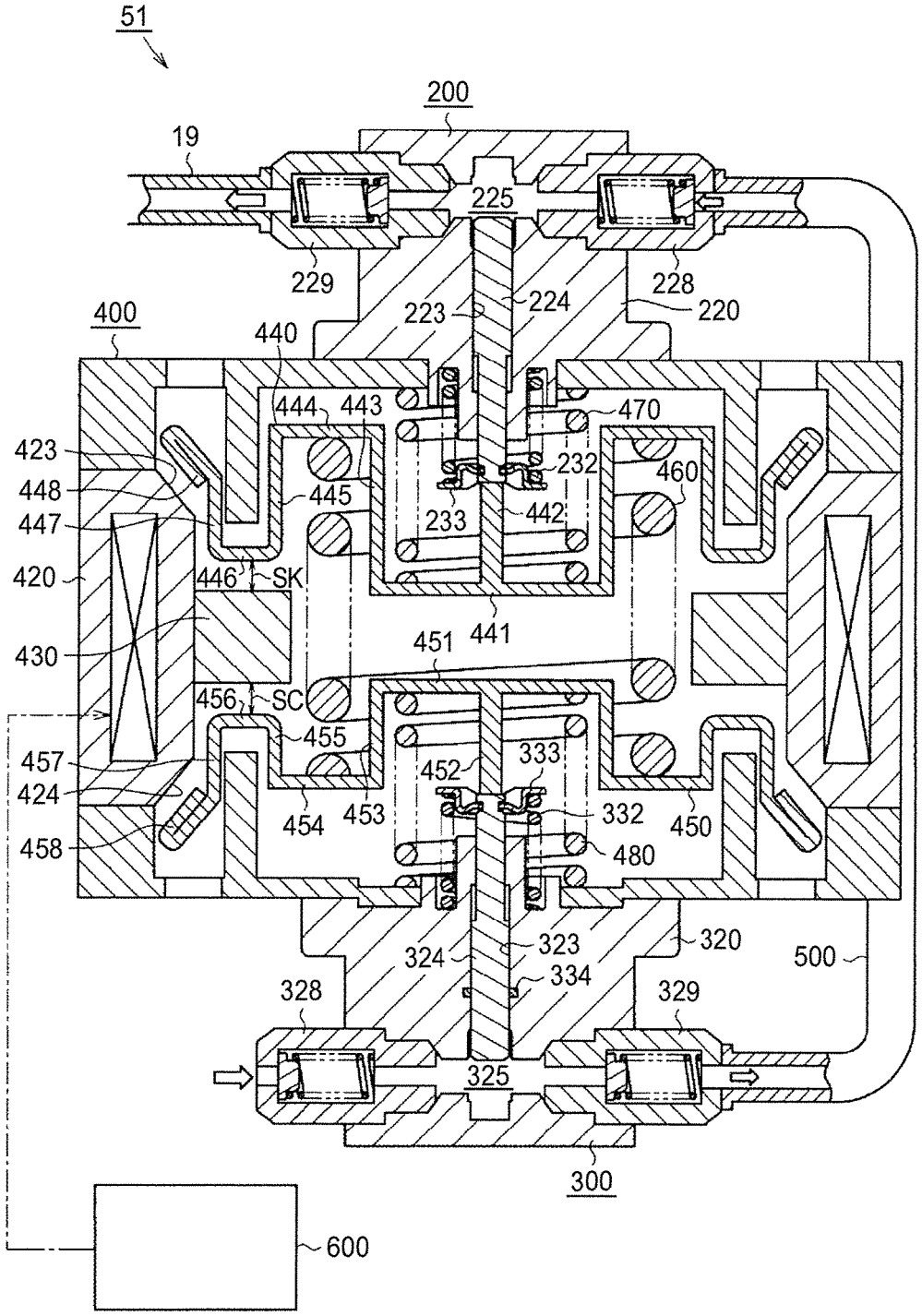
FIG. 7 is a cross-sectional view that shows an alternative embodiment of the fuel pump according to the embodiment.

FIG. 7 shows the cross-sectional structure of a fuel pump 51 according to this alternative embodiment. In the fuel pump 51 shown in FIG. 7, like reference numerals denote components common to those of the above-described embodiment, and the detailed description is omitted.

As shown in FIG. 7, the fuel pump 51 in this alternative embodiment also includes a pump unit 200 that discharges high-pressure fuel and the drive unit 400 that drives the pump unit 200. In the following description, the above-described cylinder 223 is termed first cylinder 223, and the plunger 224 that reciprocates inside the first cylinder 223 is termed first plunger 224. The pressurizing chamber 225 that is defined by the first cylinder 223 and the first plunger 224 is termed first pressurizing chamber 225, and the pump unit 200 is termed first pump unit 200.

Different from the fuel pump 50 according to the above-described embodiment, the fuel pump 51 according to this alternative embodiment includes a second pump unit 300 and a low-pressure fuel passage 500. The second pump unit 300 feeds low-pressure fuel toward the first pump unit 200. The low-pressure fuel passage 500 feeds fuel from the second pump unit 300 to the first pump unit 200.

The low-pressure fuel passage 500 is connected to the first check valve 228 of the first pump unit 200 and a fourth check valve 329 (described later). The second pump unit 300 is connected to the outer periphery of the housing 410 so as to face the first pump unit 200 in the central axis direction of the first plunger 224.

The second pump unit 300 includes a second pump body 320 in which a cylindrical second cylinder 323 is formed. A round-bar second plunger 324 is arranged in the second cylinder 323 so as to be reciprocable. The second plunger 324 is arranged coaxially with the first plunger 224. The second plunger 324 is arranged in a state where one end is inserted in the second cylinder 323 and the other end protrudes outward from the second cylinder 323. In order to prevent leakage of fuel from any gap between the inner periphery of the second cylinder 323 and the outer periphery of the second plunger 324, a ring-shaped seal member 334 is provided on the inner periphery of the second cylinder 323. As the inside of the second cylinder 323 is defined by the second plunger 324 to form a second pressurizing chamber 325 for pressurizing fuel. The volume of the second pressurizing chamber 325, the shaft diameter of the second plunger 324, and the like, are set such that the pressure of fuel that is pressurized inside the second pressurizing chamber 325 is lower than the pressure of fuel that is pressurized inside the first pressurizing chamber 225.

The second pump body 320 includes a third check valve 328. The third check valve 328 permits flow of fuel inside the fuel tank 10 into the second pressurizing chamber 325, and blocks flow of fuel from the second pressurizing chamber 325 into the fuel tank 10.

The second pump body 320 includes the fourth check valve 329. The fourth check valve 329 permits flow of low-pressure fuel, pressurized inside the second pressurizing chamber 325, into the low-pressure fuel passage 500, and blocks flow of fuel from the low-pressure fuel passage 500 to the second pressurizing chamber 325.

An annular spring seat 333 is assembled to the end of the second plunger 324, which protrudes outward from the second cylinder 323. A spring 332 is arranged between the spring seat 333 and the second pump body 320. The spring 332 urges the second plunger 324 in a direction in which the second plunger 324 recedes from the second pressurizing chamber 325.

The second pump unit 300 is assembled to the outer periphery of the housing 410 such that the end of the second plunger 324, on which the spring seat 333 is provided, is exposed to the inside of the housing 410.

A bar-shaped second connecting portion 452 extends from the center of the fourth planar portion 451 of the second movable element 450 toward the end of the second plunger 324. The second connecting portion 452 is connected to the end of the second plunger 324.

Figure 8:
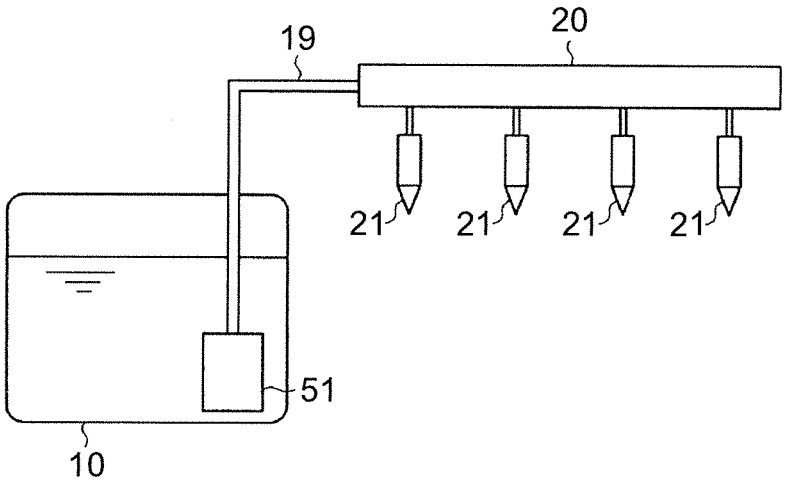
FIG. 8 is a schematic view that schematically shows the configuration of a fuel system of an engine, in which the fuel pump according to the alternative embodiment is arranged.

As shown in FIG. 8, the fuel pump 51 is provided inside the fuel tank 10, and fuel inside the fuel tank 10 is drawn to the fuel pump 51, pressurized and then fed to the delivery pipe 20 under pressure.

In this fuel pump 51, the second connecting portion 452 provided at the fourth planar portion 451 of the second movable element 450 is connected to the end of the second plunger 324, and, as the second movable element 450 reciprocates, the second plunger 324 also reciprocates. As a result of the reciprocation of the second plunger 324, fuel drawn to the second pressurizing chamber 325 is fed to the low-pressure fuel passage 500 under pressure. Fuel fed to the low-pressure fuel passage 500 under pressure is pressurized inside the first pressurizing chamber 225 of the first pump unit 200, and is then discharged to the high-pressure fuel passage 19.

In this way, in the fuel pump 51, the second plunger 324 is also reciprocated by the reciprocating second movable element 450, so it is possible to drive two pump units with the use of one fuel pump without additionally providing a drive mechanism for reciprocating the second plunger 324. Therefore, for example, the above-described feed pump 11 or the controller 600 that controls the driving of the feed pump 11 may be omitted.

In the above-described embodiment or its alternative embodiment, the second spring 470 and the third spring 480 may be omitted. In this case as well, at least the advantageous effects other than the above (2) and (3) are obtained.

The stroke amount ST of the plunger 224 is changed in order to variably set the displacement of the fuel pump 50. Instead, if the displacement is not changed, the stroke amount ST may be a fixed amount.

The shapes of the electromagnet 420, magnetic member 430, first movable element 440 and second movable element 450 are illustrative, and may be changed as needed.

What is claimed is:

1. A fuel pump comprising:

a first pump unit including a first cylinder, a first plunger that reciprocates inside the first cylinder, and a first pressurizing chamber defined by the first cylinder and the first plunger, the first pump unit being configured to pressurize fuel inside the first pressurizing chamber by moving the first plunger inside the first cylinder;

a first movable element connected to the first plunger;

a second movable element provided so as to face the first movable element in a direction in which the first plunger moves, the second movable element being configured to function as a counterweight for preventing or reducing vibrations that are created by reciprocation of the first movable element;

an electromagnet provided between the first movable element and the second movable element;

a magnetic member provided between the first movable element and the second movable element, the magnetic member being configured to attract both the first movable element and the second movable element when the electromagnet is energized; and a first spring configured to urge both the first movable element and the second movable element so as to move away from each other.

2. The fuel pump according to claim 1, further comprising:

a housing that accommodates the first movable element and the second movable element;

a second spring arranged between the first movable element and the housing, the second spring being configured to urge the first movable element in a direction in which the first movable element approaches the magnetic member; and a third spring arranged between the second movable element and the housing, the third spring being configured to urge the second movable element in a direction in which the second movable element approaches the magnetic member.

3. The fuel pump according to claim 1, further comprising:

a second pump unit including a second cylinder, a second plunger that reciprocates inside the second cylinder, and a second pressurizing chamber defined by the second cylinder and the second plunger, the second pump unit being configured to pressurize fuel inside the second pressurizing chamber by moving the second plunger inside the second cylinder, wherein the second plunger is connected to the second movable element.

4. The fuel pump according to claim 1, wherein the fuel pump is provided inside a fuel tank.

5. The fuel pump according to claim 2, further comprising:

a second pump unit including a second cylinder, a second plunger that reciprocates inside the second cylinder, and a second pressurizing chamber defined by the second cylinder and the second plunger, the second pump unit being configured to pressurize fuel inside the second pressurizing chamber by moving the second plunger inside the second cylinder, wherein the second plunger is connected to the second movable element.

* * * * *